US008961222B2

(12) United States Patent
Wang et al.

(10) Patent No.: US 8,961,222 B2
(45) Date of Patent: Feb. 24, 2015

(54) COAXIAL CABLE CONNECTOR STRUCTURE

(75) Inventors: Shou-Ying Wang, Taipei (TW); Tien Shou Yao, Taipei (TW)

(73) Assignee: JJS Communications Co., Ltd., Taipei (TW)

( * ) Notice: Subject to any disclaimer, the term of this patent is extended or adjusted under 35 U.S.C. 154(b) by 114 days.

(21) Appl. No.: 13/344,912

(22) Filed: Jan. 6, 2012

(65) Prior Publication Data

US 2013/0090008 A1 Apr. 11, 2013

(30) Foreign Application Priority Data

Oct. 7, 2011 (TW) ..... 100218900 U

(51) Int. Cl.
*H01R 9/05* (2006.01)
*H01R 33/975* (2006.01)

(52) U.S. Cl.
CPC ..... *H01R 33/975* (2013.01); *H01R 9/05* (2013.01)
USPC ..... 439/578

(58) Field of Classification Search
USPC ..... 439/578–585, 63, 733.1, 944, 271, 439/98–99
See application file for complete search history.

(56) References Cited

U.S. PATENT DOCUMENTS

| | | | | |
|---|---|---|---|---|
| 6,716,062 | B1 * | 4/2004 | Palinkas et al. | 439/578 |
| 8,062,063 | B2 * | 11/2011 | Malloy et al. | 439/578 |
| 2008/0102696 | A1 * | 5/2008 | Montena | 439/578 |
| 2008/0311790 | A1 * | 12/2008 | Malloy et al. | 439/583 |

* cited by examiner

*Primary Examiner* — Edwin A. Leon
(74) *Attorney, Agent, or Firm* — Sheridan Ross P.C.

(57) ABSTRACT

A coaxial cable connector structure including a sleeve and an annular nut on the front end of the sleeve is disclosed, wherein an inner tube is disposed inside the sleeve for connecting the coaxial cable, and a spring is disposed on the bottom of the annular nut for the end surface of the connection base towards the annular nut to contact the spring and electrically connect the inner tube when the connection base is screwed into the annular nut, so that the coaxial cable connector structure can transmit signals when it is not completely screwed onto the connection base, and provide the effect of vibration suppression from the compressed spring having its two ends abutted against the bottom of the annular nut and the end surface of the connection base by the elastic restoring force when the connection base is completely screwed onto the connection base.

17 Claims, 12 Drawing Sheets

COAXIAL CABLE CONNECTOR STRUCTURE

BACKGROUND OF THE INVENTION

1. Field of the Invention

The present invention relates to a coaxial cable connector structure, and more particularly to a coaxial cable connector structure having a spring disposed inside the annular nut for electrically connecting the coaxial cable connector and the connection base when the coaxial cable connector is loosened or not completely screwed onto the connection base.

2. Description of Related Art

The coaxial cable is a signal transmission cable widely used in television and network systems, which is fixed on the corresponding connection base of a video or network equipment by the coaxial cable connector set at the end. For example, a common F-type coaxial cable connector connects to the coaxial cable through a sleeve, a rotatable annular nut is disposed on the front end of the sleeve, and an inner thread is disposed on the inner surface of the annular nut and a hexagonal outer wall is disposed on its outer surface for rotating to fasten by fingers or clamping tools.

The annular nut needs to be rotated repeatedly for completely rotating inside the connection base when fastening the abovementioned coaxial cable connector on the connection base by manual rotating, to thereby ensure electrical connection for transmitting signals from the coaxial cable. However, since the outer contact area of the annular nut is small, it cannot be effectively forced to rotate by fingers, the motion of fastening the annular nut by fingers is time-consuming and labor-intensive. Also, since the connection base is disposed on the back side of the abovementioned equipments mostly, users should move out the equipments for completely fastening the coaxial cable connector behind when the equipments are set in a narrow space, thus it may cause considerable inconvenience.

In view of this, in order to improve the abovementioned defects for transmitting signals when the coaxial cable connector structure is not completely fastened on the connection base, to thereby increase convenience in use. Due to the experiences in many years and continuous developments and improvements, the inventor completes the present invention.

SUMMARY OF THE INVENTION

The object of the present invention is to provide a coaxial cable connector structure, wherein a spring is disposed on the bottom of the annular nut for the end surface of the connection base towards the annular nut to contact the spring and electrically connect the inner tube of the sleeve when the connection base is not completely screwed into the inner thread of the annular nut.

In order to achieve the abovementioned object, the coaxial cable connector structure according to the present invention includes a sleeve and an annular nut disposed on the front end of the sleeve, and an inner tube is disposed inside the sleeve for connecting the coaxial cable, and the annular nut has an inner thread on its inner surface for combining with a connection base having an outer thread, wherein a spring is disposed on the bottom of the annular nut for the end surface of the connection base towards the annular nut to contact the spring and electrically connect the inner tube when the connection base is screwed into the inner thread of the annular nut.

When implemented, a flange part is disposed on the front end of the inner tube for engaging the bottom of the annular nut, and a gap is formed between the flange part and the annular nut for receiving the spring inside.

When implemented, the flange part has an indentation thereon for receiving an O-ring within it.

When implemented, one end of the spring is fixed on the bottom of the annular nut.

When implemented, the spring is engaged on the inner thread of the annular nut.

When implemented, the outer diameter of the spring is smaller than or equal to the inner diameter of the annular nut.

When implemented, the spring is a metal spring with the electric conductivity.

When implemented, the thickness of the flange part is greater than or equal to the height of the spring after being compressed.

When implemented, a flange part is disposed on the front end of the inner tube for engaging the bottom of the annular nut, and a groove is disposed on the flange part for placing and receiving the spring inside.

When implemented, the depth of the groove is greater than or equal to the height of the spring after being compressed.

In order to further understand the present invention, the prefer embodiments are described with figures and numbers as follow to illustrate the practical construction and the achieved effects of the present invention.

DETAILED DESCRIPTION OF THE INVENTION

Figure 1:
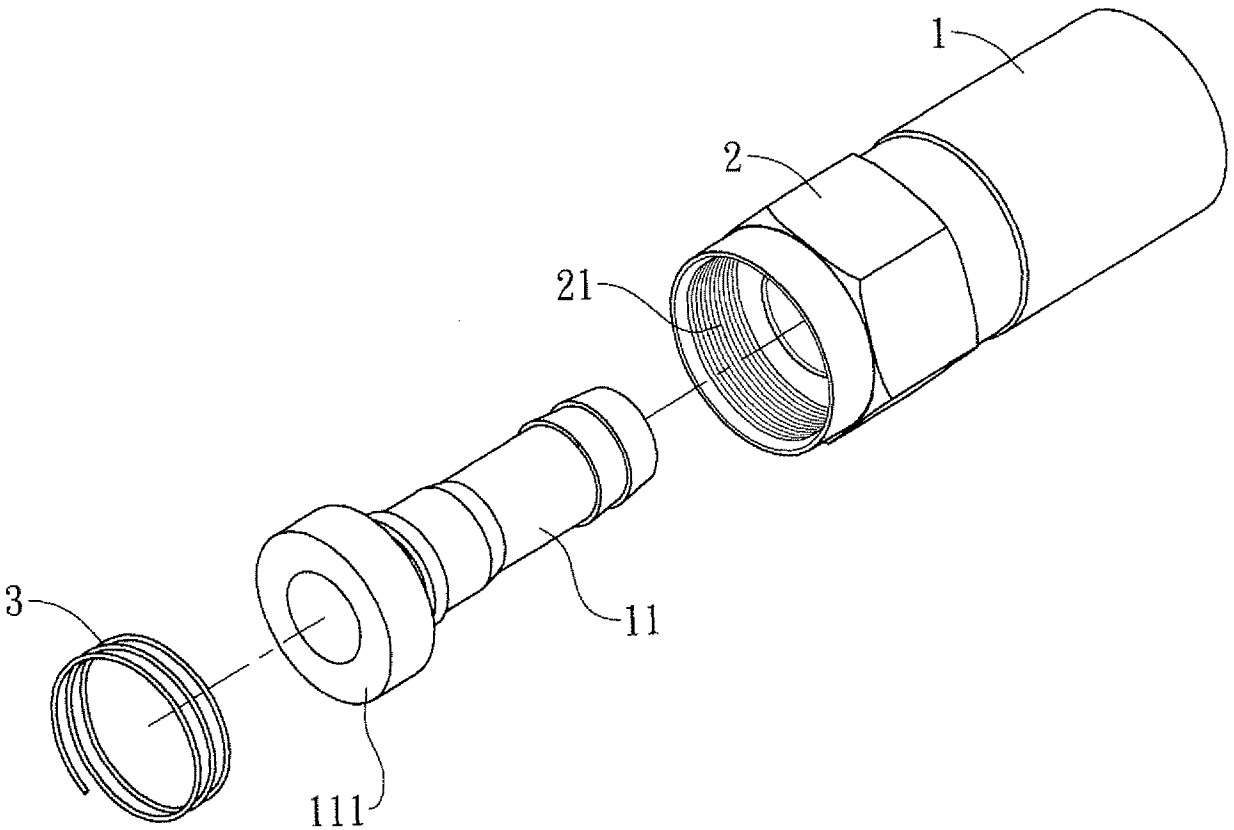
FIG. 1 is a schematic combination diagram of a coaxial cable connector structure according to the first embodiment of the present invention.
Figure 2:
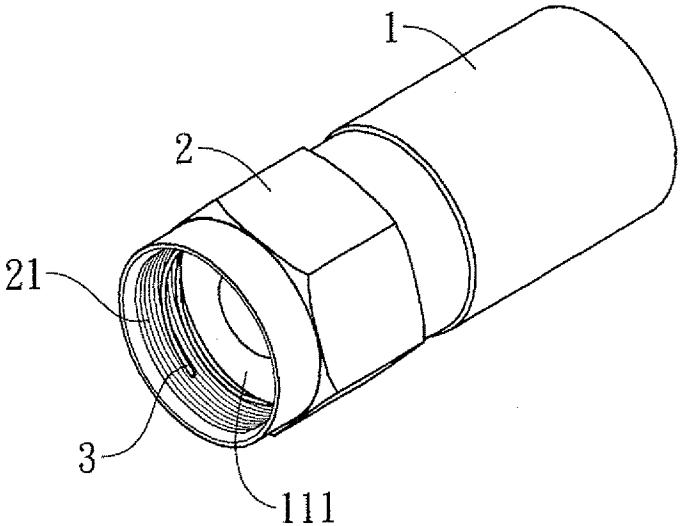
FIG. 2 is a three-dimension diagram of the embodiment in FIG. 1.
Figure 3:
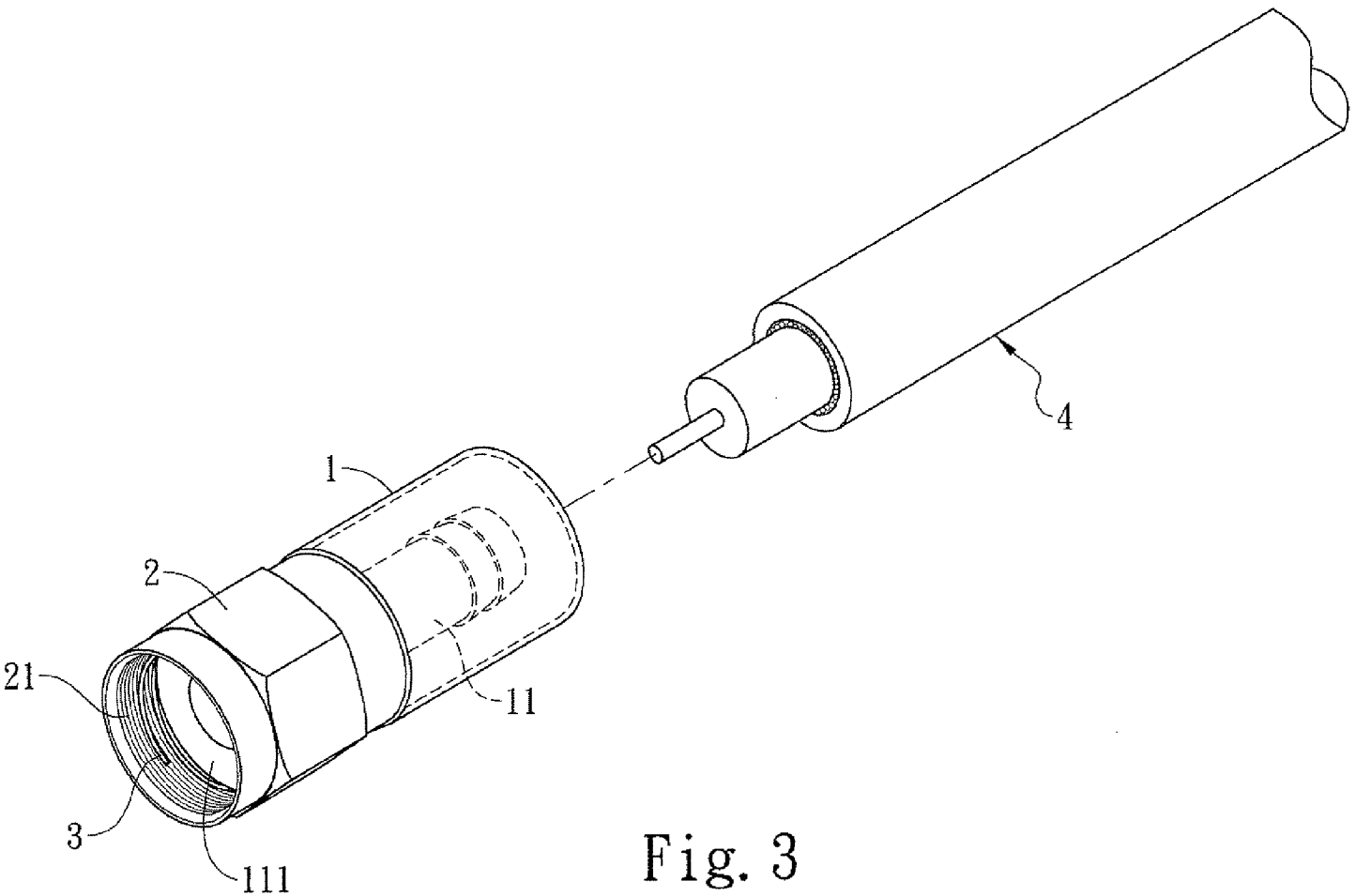
FIG. 3 is a schematic combination diagram of the embodiment in FIG. 1 when being combined with the coaxial cable.
Figure 4:
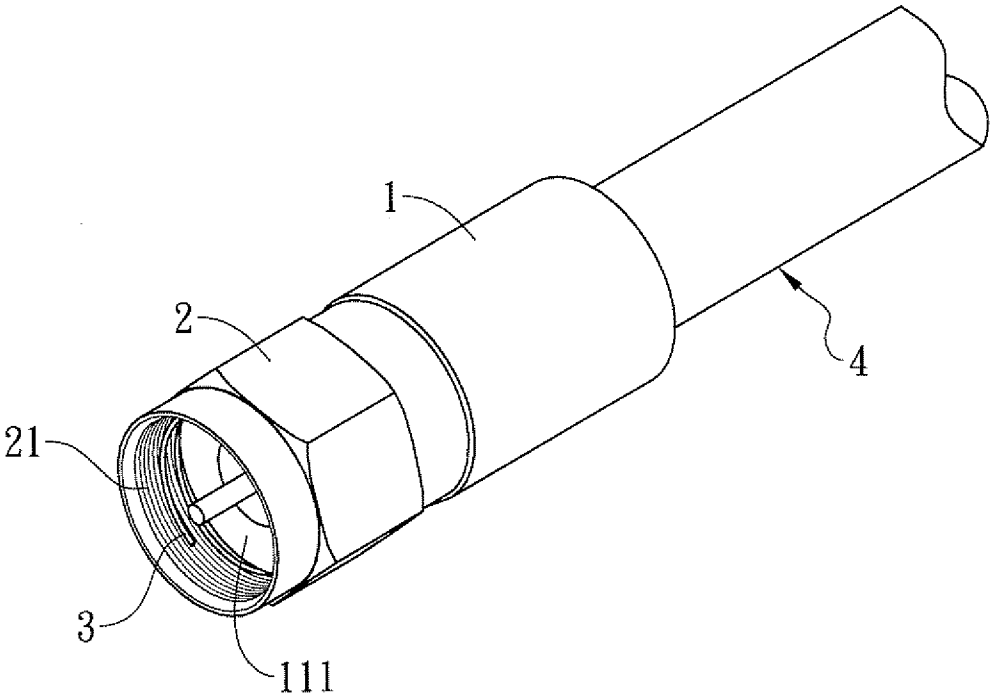
FIG. 4 is a three-dimension diagram of the embodiment in FIG. 1 after being combined with the coaxial cable.

Please refer to FIG. 1 and FIG. 2, which are the first embodiment of the coaxial cable connector structure of the present invention, and includes a sleeve 1, an annular nut 2 disposed on the front end of the sleeve 1, and a spring 3, wherein an inner tube 11 is disposed inside the sleeve 1 for connecting the coaxial cable 4 (as shown in FIG. 3 and FIG. 4), and a flange part 111 disposed on the front end of the inner tube 11 is combined with the bottom inside the annular nut 2 for spacing the annular nut 2 on the front end of the sleeve 1, and a gap 20 is formed between the flange part 111 and the annular nut 2. The annular nut 2 has an inner thread 21 on its inner surface for connecting a connection base 5 having an outer thread 51 (as shown in FIG. 6A).

Figure 5:
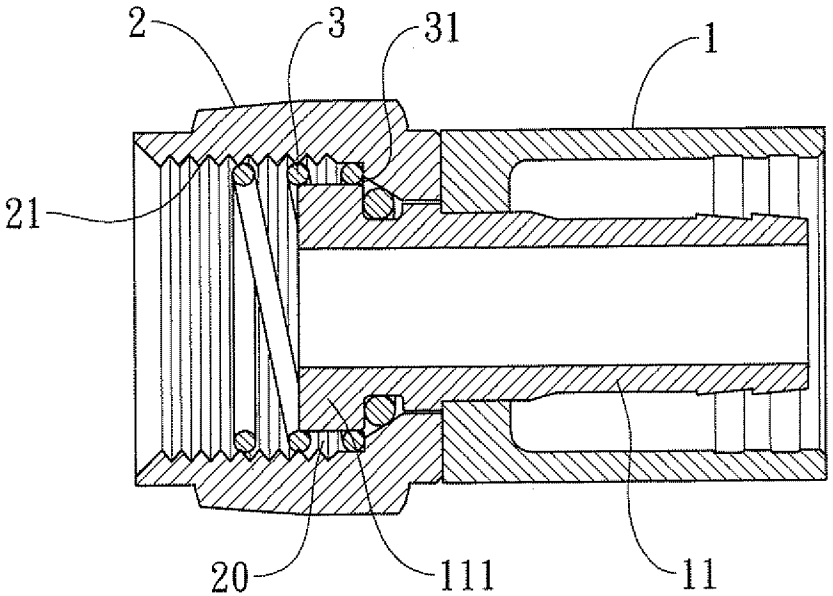
FIG. 5 is a schematic section diagram of the embodiment in FIG. 1.

The spring 3 is made of electric conductive metal material, and disposed inside the gap 20 between the flange part 111 and the annular nut 2 in the annular nut 2 (as shown in FIG. 5). The bottom end 31 of the spring 3 is fixed on the bottom of the annular nut 2, and the outer diameter of the spring 3 is slightly smaller than the inner diameter of the annular nut 2 for engaging the inner thread 21 of the annular nut 2. The outer diameter of the spring 2 may be designed as equal to the inner diameter of the annular nut 2.

Figure 6A:
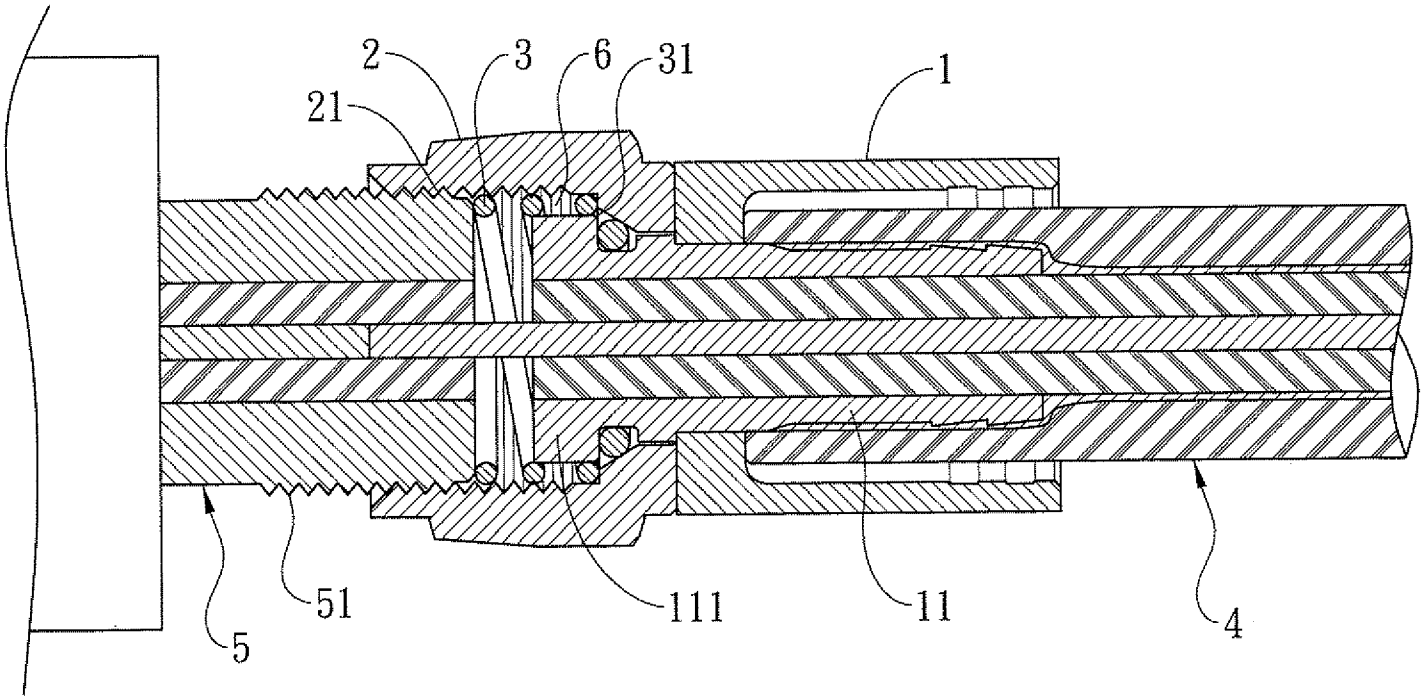
FIG. 6A is a schematic section diagram of the embodiment in FIG. 1 when being combined with the coaxial cable.
Figure 6B:
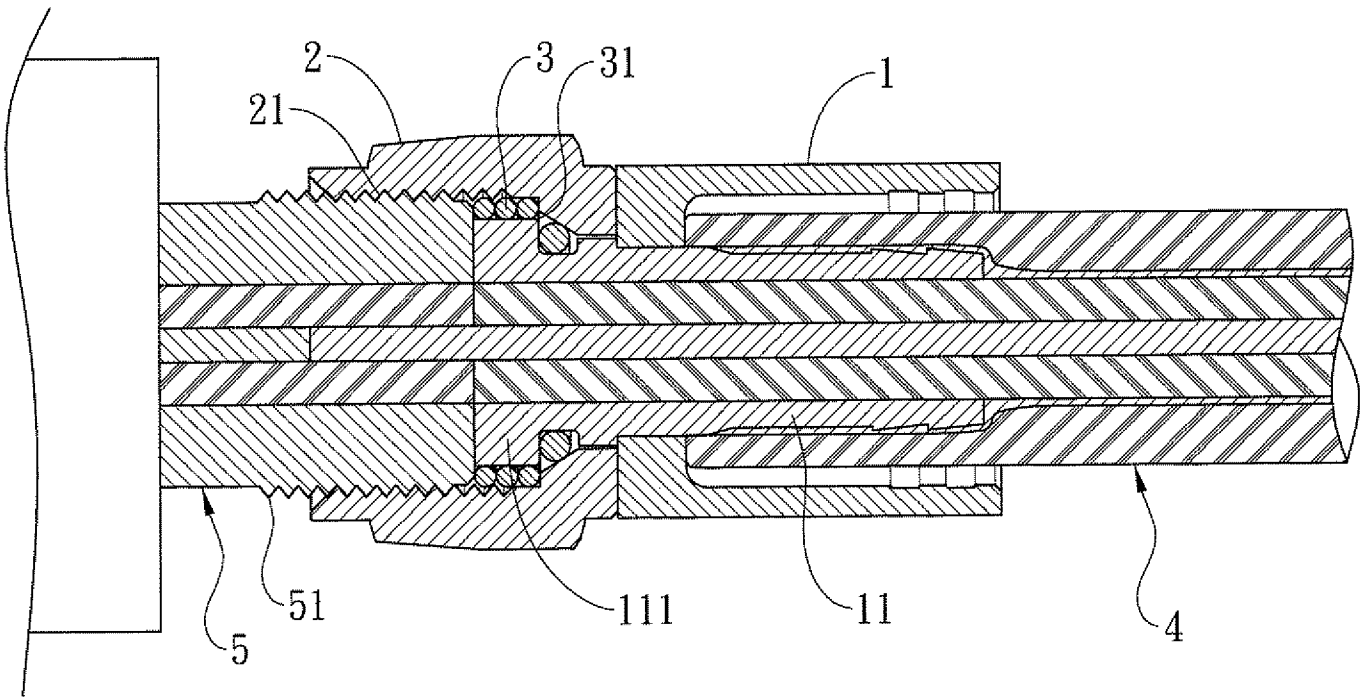
FIG. 6B is a schematic section diagram of the embodiment in FIG. 1 after being combined with the coaxial cable.

When implemented, please refer to FIG. 6A and FIG. 6B, according to the present invention, when the connection base 5 is screwed into the annular nut 2, it allows the end surface of the connection base 5 towards the annular nut 2 to contact the spring 3 and electrically connect to the inner tube 11 of the annular nut 2 via the spring 3. Besides, the thickness of the flange part 111 is greater than or equal to the height of the spring 3 after being compressed for completely placing and receiving the compressed spring 3 in the gap 20 when the connection base 5 is completely screwed into the annular nut 2 and the end surface of the connection base 5 towards the annular nut 2 contacts the upper surface of the inner tube 11 to electrically connect for transmitting signals.

Figure 7:
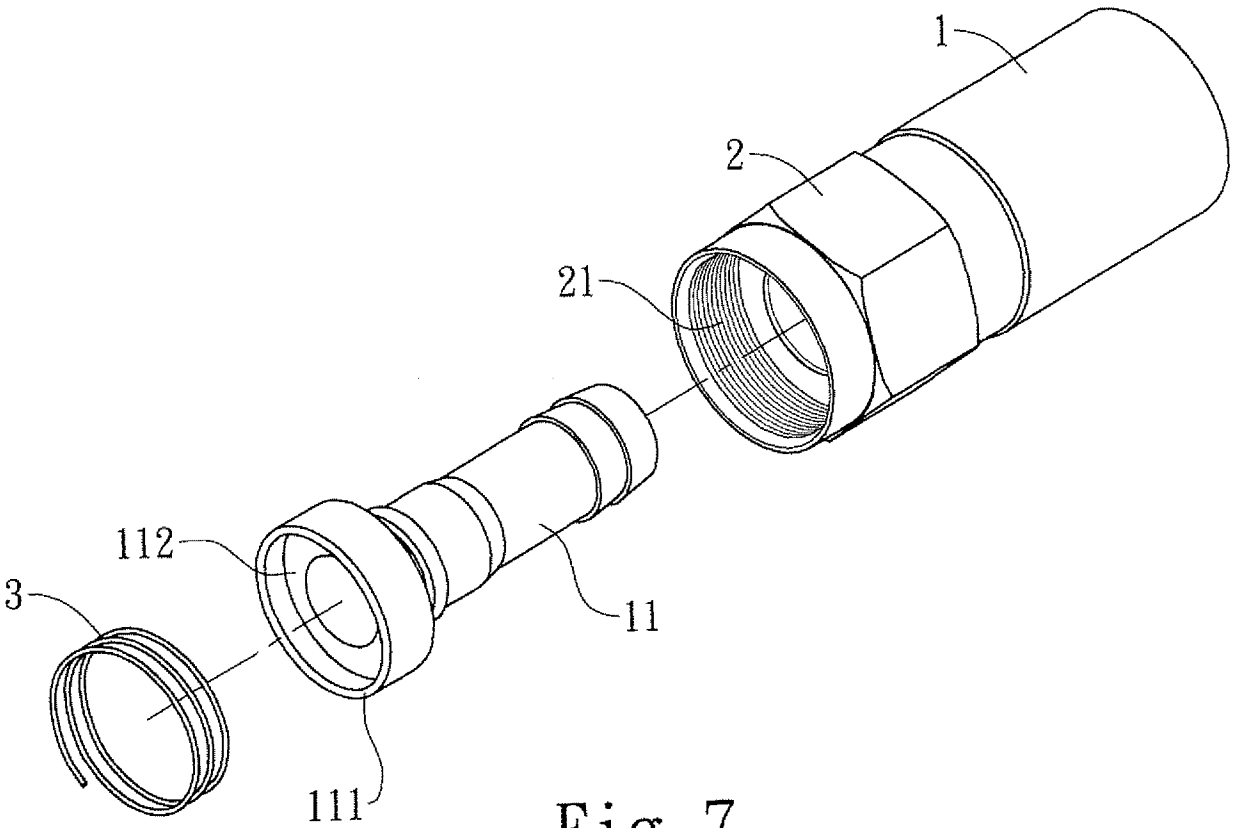
FIG. 7 is a three-dimension diagram of a coaxial cable connector structure according to the second embodiment of the present invention.
Figure 8:
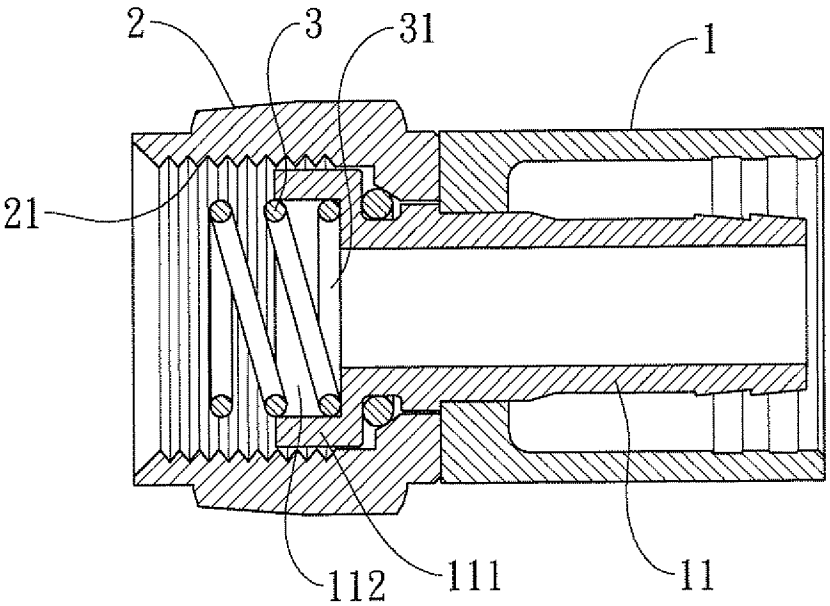
FIG. 8 is a schematic section diagram of the embodiment in FIG. 7 after being combined with the coaxial cable.

Please refer to FIG. 7 and FIG. 8, which is the second embodiment of the coaxial cable connector structure according to the present invention, and using the structure of the abovementioned first embodiment as its base. A flange part 111 is disposed on the front end of the inner tube 11 on the bottom of the annular nut 2 for engaging the bottom of the annular nut 2. A groove 112 is disposed on the flange part 111, and the depth of the groove 112 is greater than or equal to the height of the spring 3 after being compressed for completely placing and receiving the spring 3 after being compressed inside.

Figure 9:
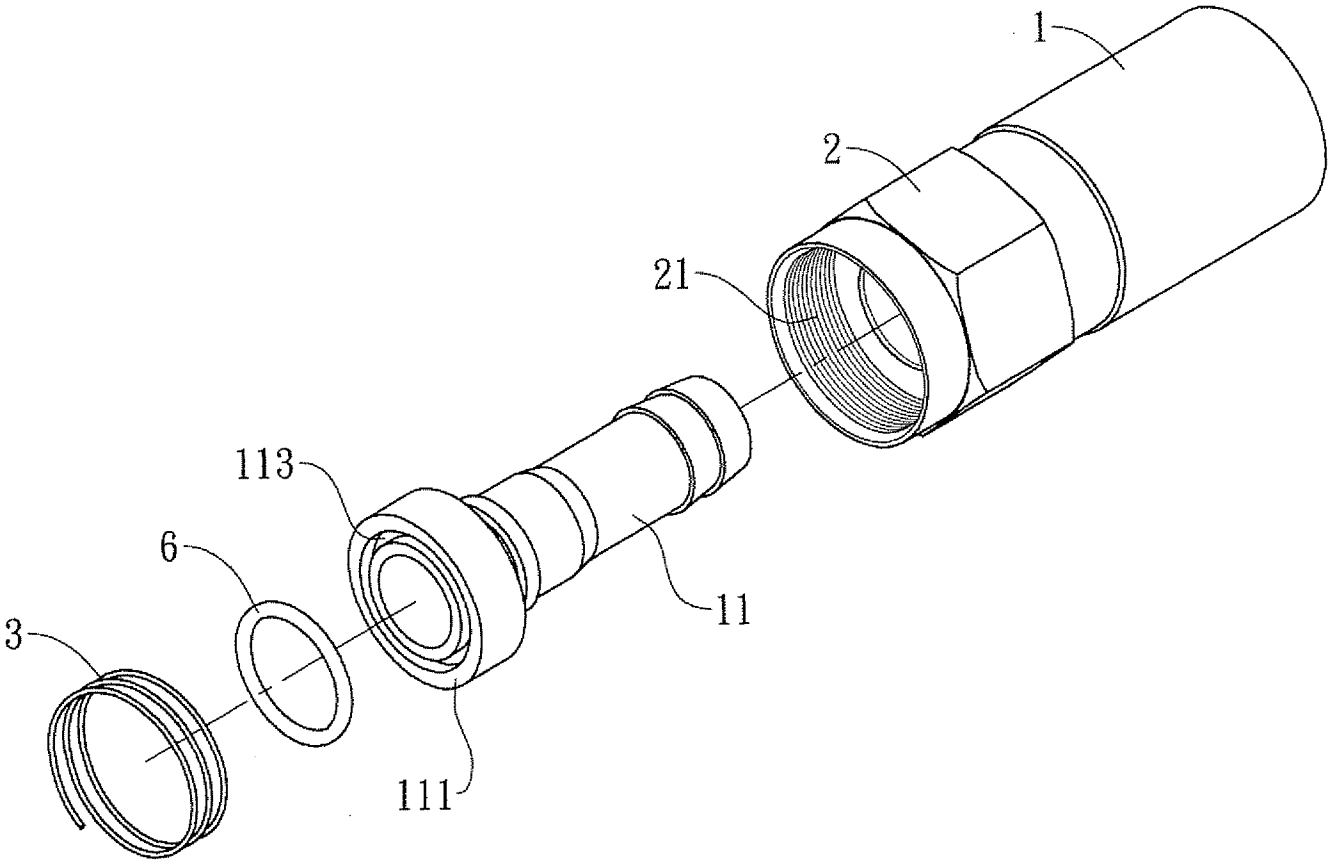
FIG. 9 is a three-dimension diagram of a coaxial cable connector structure according to the third embodiment of the present invention.
Figure 10A:
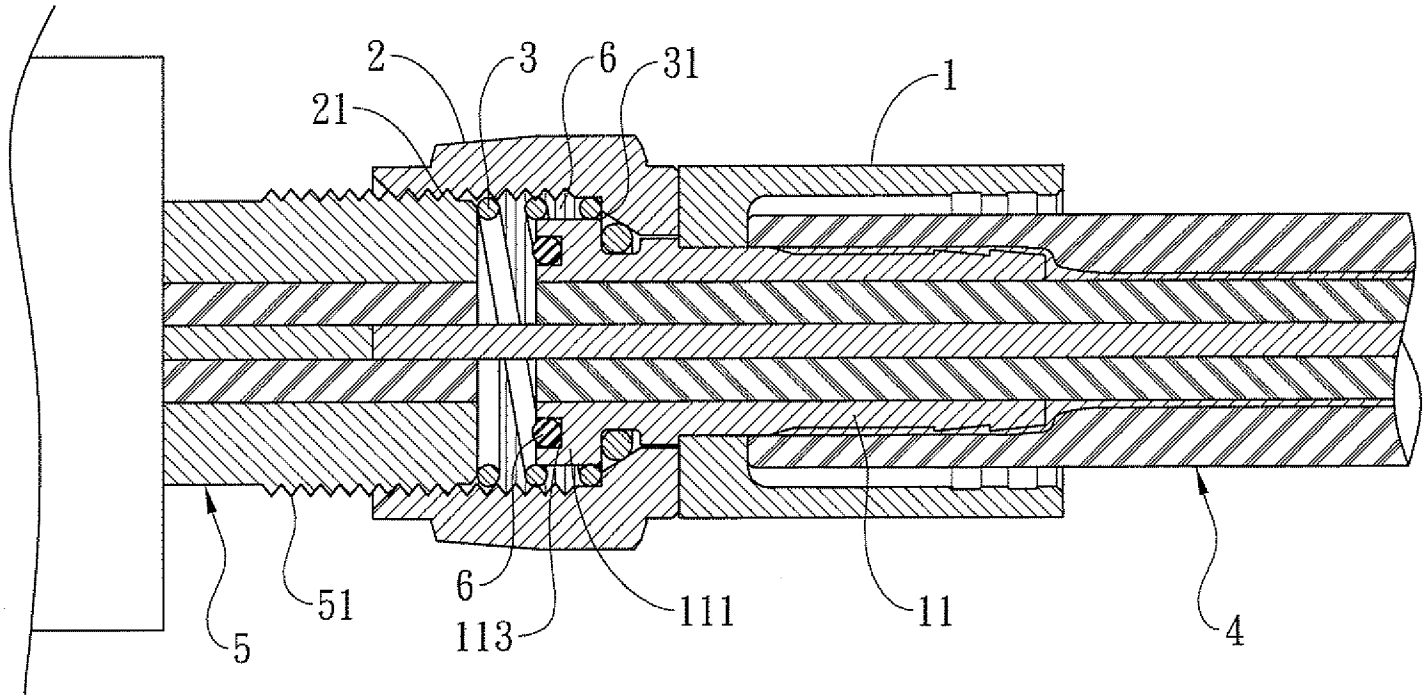
FIG. 10A is a schematic section diagram of the embodiment in FIG. 9 when the connection base is screwed into the annular nut.
Figure 10B:
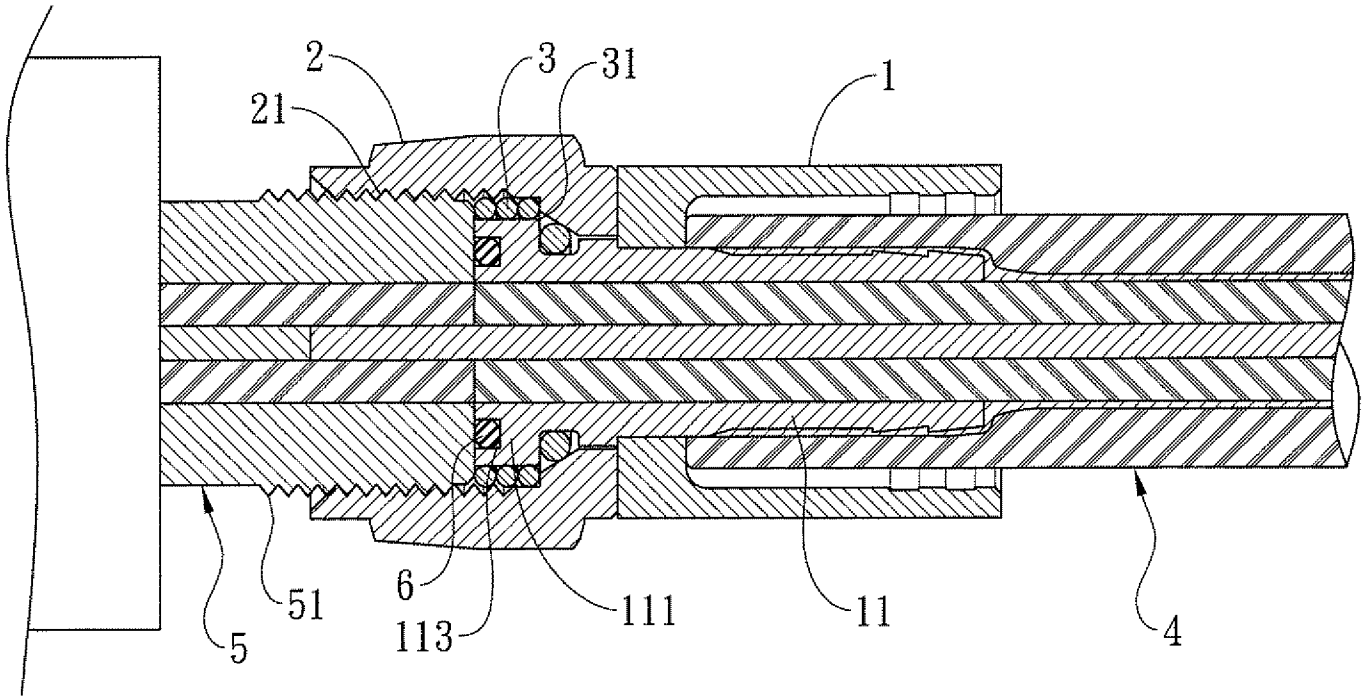
FIG. 10B is a schematic section diagram of the embodiment in FIG. 9 when the connection base is totally screwed into the annular nut.

Please refer to FIG. 9, which is the third embodiment of the coaxial cable connector structure according to the present invention, and using the structure of the abovementioned first embodiment as its base. An indentation 113 is disposed on the flange part 111 for receiving an O-ring 6 within the indentation 113. The cross-sectional diameter of the O-ring 6 is lightly larger than the depth of the indentation 113 (as shown in FIG. 10), so that when the connection base 5 is totally screwed into the annular nut 2 and pressing the O-ring 6 with the end surface of the connection base 5 towards the annular nut 2, a sealing barrier is formed between the end surface of the connection base 5 and the flange part 111 to prevent water from flowing into the central copper conductor of the coaxial cable 4.

Therefore, the present invention has the following advantages:

1. In a general installation process, the spring may be used for conducting signals of the coaxial cable when the coaxial cable connector is hard to completely screw onto the connection base, so users may conveniently operate in a narrow space, and the present invention may keep transmitting signal when the coaxial cable connector is loosened.

2. When the coaxial cable connector and the connection base are in the condition of completely screwed, because of elastic restoring force, two ends of the compressed spring are respectively abutted against the bottom of the coaxial cable connector and the end surface of the connection base towards the annular nut, and the spring can provide the effect of vibration suppression when the coaxial cable connector and the connection base suffer external vibration.

3. When water accidentally flows into the connection base, the present invention can maintain the transmitting of electrical signals of the coaxial cable by the O-ring disposed on the flange part of the connection base, thereby increasing the practicality significantly.

4. The structure of the present invention is simple and may be directly applied in the current specification of the coaxial cable connector, to increase the practicality significantly.

In summary, according to the contents disclosed above, the present invention may indeed achieve the intended purpose to provide a coaxial cable connector structure, which may transmit signals when the coaxial cable connector cannot be fastened into the connection completely or the coaxial cable connector is loosened. Thus, the present invention has industrial application and the inventor files an application for a patent according to law.

It should be understood that different modifications and variations could be made from the disclosures of the present invention by the people familiar in the art without departing the spirit of the present invention.

What is claimed is:

1. A coaxial cable connector structure including a sleeve and an annular nut disposed on the front end of the sleeve, and an inner tube disposed inside the sleeve for connecting the coaxial cable, the annular nut having an inner thread on its inner surface for combining with a connection base having an outer thread, characterized in that a coil spring is disposed on the bottom of the annular nut for the end surface of the connection base towards the annular nut to contact the spring and electrically connect the inner tube when the connection base is partially screwed into the inner thread of the annular nut, and when the connection base is fully screwed into the inner thread of the annular nut the end surface of the connection base will contact the inner tube and the coil spring.

2. The coaxial cable connector structure as claimed in claim 1, wherein a flange part is disposed on the front end of the inner tube for engaging the bottom of the annular nut, and a gap is formed between the flange part and the annular nut for receiving the spring inside.

3. The coaxial cable connector structure as claimed in claim 2, wherein the flange part has an indentation thereon for receiving an O-ring within it.

4. The coaxial cable connector structure as claimed in claim 2, wherein one end of the coil spring is fixed on the bottom of the annular nut.

5. The coaxial cable connector structure as claimed in claim 2, wherein the coil spring is engaged on the inner thread of the annular nut.

6. The coaxial cable connector structure as claimed in claim 2, wherein the outer diameter of the coil spring is smaller than or equal to the inner diameter of the annular nut.

7. The coaxial cable connector structure as claimed in claim 2, wherein the coil spring is a metal coil spring with electric conductivity.

8. The coaxial cable connector structure as claimed in claim 2, wherein the thickness of the flange part is greater than or equal to the height of the coil spring after being compressed.

9. The coaxial cable connector structure as claimed in claim 1, wherein a flange part is disposed on the front end of the inner tube for fixing the bottom of the annular nut, and a groove is disposed on the flange part for receiving the coil spring.

10. The coaxial cable connector structure as claimed in claim 9, wherein the coil spring is a metal spring with electric conductivity.

11. The coaxial cable connector structure as claimed in claim 9, wherein the depth of the groove is greater than or equal to the height of the coil spring after being compressed.

12. A coaxial cable connector structure including a sleeve and an annular nut disposed on the front end of the sleeve, and an inner tube disposed inside the sleeve for connecting the coaxial cable, the annular nut having an inner thread on its inner surface for combining with a connection base having an outer thread, the inner tube having a front end with a front surface toward the connection base and wherein the front end of the inner tube has an outer surface of a diameter less than the diameter of the inner thread of the annular nut such that a gap is formed between the outer surface of the front end of the inner tube and the inner threads of the annular nut, a coil spring having a rearward end and a forward end, the rearward end of the coil spring having one or more windings that frictionally engage the outer surface of the front end of the inner tube such that the rearward end of the spring is disposed within the gap and the forward end of the coil spring extends forward of the front surface of the front end of the inner tube for the end surface of the connection base towards the annular nut to contact and electrically connect the inner tube when the connection base is partially screwed into the inner thread of the annular nut, and when the connection base is fully screwed into the inner thread of the annular nut the end surface of the connection base will contact the front surface of the front end of the inner tube, and the coil spring will remain in contact with the end surface of the connection base and the outer surface of the inner tube.

13. The coaxial cable connector structure of claim 12, wherein the rearward end of the coil spring is fixed on the bottom of the annular nut.

14. The coaxial cable connector structure of claim 12, wherein the spring engages the inner thread of the annual nut.

15. The coaxial cable connector structure of claim 12, further comprising a groove formed on the front end of the inner tube for receiving the rearward end of the spring.

16. The coaxial cable connector structure of claim 12, wherein the entire spring is disposed within the gap when the connection base is fully screwed into the inner thread of the annular nut.

17. The coaxial cable connector structure of claim 12, wherein the annular nut further comprises a bottom end and the rearward end of the spring engages the bottom end of the nut to dampen vibration of the annular nut.

* * * * *